US011660903B2

(12) United States Patent
Wang

(10) Patent No.: US 11,660,903 B2
(45) Date of Patent: May 30, 2023

(54) WRITING INSTRUMENT

(71) Applicant: QINGDAO BEST POINT STATIONERY CO., LTD., Qingdao (CN)

(72) Inventor: Yuanhong Wang, Hangzhou (CN)

(73) Assignee: QINGDAO BEST POINT STATIONERY CO., LTD., Qingdao (CN)

( * ) Notice: Subject to any disclaimer, the term of this patent is extended or adjusted under 35 U.S.C. 154(b) by 0 days.

(21) Appl. No.: 17/334,395

(22) Filed: May 28, 2021

(65) Prior Publication Data

US 2021/0379923 A1 Dec. 9, 2021

(30) Foreign Application Priority Data

Jun. 5, 2020 (CN) ..... 202010505793.8

(51) Int. Cl.
*B43K 5/18* (2006.01)
*B43K 5/02* (2006.01)
(Continued)

(52) U.S. Cl.
CPC ..... *B43K 5/18* (2013.01); *B43K 1/12* (2013.01); *B43K 5/02* (2013.01); *B43K 23/12* (2013.01)

(58) Field of Classification Search
CPC ... B43K 8/04; B43K 8/06; B43K 8/08; B43K 8/12
See application file for complete search history.

(56) References Cited

U.S. PATENT DOCUMENTS 7,073,967 B2 * 7/2006 Choi ..... B43K 8/04 401/199
7,578,631 B2 * 8/2009 Kurita ..... B43K 8/06 401/223
2013/0004231 A1 * 1/2013 Nakatani ..... B43K 8/03 401/198

FOREIGN PATENT DOCUMENTS

CN 104619514 5/2015
CN 104985949 10/2015
(Continued)

*Primary Examiner* — David P Angwin
*Assistant Examiner* — Bradley S Oliver
(74) *Attorney, Agent, or Firm* — Jiwen Chen; Joywin IP Law PLLC

(57) ABSTRACT

Provided is a writing instrument including a pen cap, a pen tip and a pen barrel, wherein the pen tip is arranged at one end of the pen barrel, an ink cartridge configured to store ink is formed at the other end of the pen barrel, and the pen cap able to be removed is provided on the pen barrel for covering the pen tip; wherein the writing instrument further includes: an ink delivery assembly including a first tube body, a second tube body, a liquid guiding column and liquid absorbent cotton, wherein the second tube body is inserted into the first tube body, the liquid guiding column is inserted into the second tube body, the liquid absorbent cotton is arranged inside the first tube body, an inner end of the pen tip is inserted into the first tube body, and an end of the first tube body which is away from the pen tip is opened with a first vent and an end of the second tube body which is close to the pen tip is opened with a second vent; the first tube body is arranged in the pen barrel; an air flow channel is formed between an inner wall of the pen barrel and the first tube body; the second tube body is in communication with the ink cartridge; a part of the pen barrel corresponding to where the pen tip is arranged is provided with a plurality of ribs, and an air inlet is enclosed by the pen tip and any two
(Continued)

adjacent ribs, and the air inlet is in communication with the air flow channel. The writing instrument could increase ink storage capacity and avoid ink leakage, thereby improving user experience.

7 Claims, 8 Drawing Sheets

(51) Int. Cl.
*B43K 1/12* (2006.01)
*B43K 23/12* (2006.01)

(56) References Cited

FOREIGN PATENT DOCUMENTS

| | | | | | |
|---|---|---|---|---|---|
| CN | 105196735 | | | 12/2015 | |
| KR | 100985587 | B1 | * | 10/2010 | |
| KR | 20220026064 | A | * | 3/2022 | ..... B43K 8/06 |

* cited by examiner

WRITING INSTRUMENT

This application claims the priority benefit of Chinese Application No. 202010505793.8, filed Jun. 5, 2020, which is hereby incorporated by reference.

TECHNICAL FIELD

The present invention relates to a writing instrument item.

BACKGROUND

Writing pens (signature pens, oil-based pens, gel pens, marker pens, etc.) are items essential for people's daily life and work. Among them, the marker pen is widely used and its quality is measured by three key factors including ink storage, smoothness and ink leakage in usage. Chinese Patent (No. 201380047596.4, No. 201510562402.5 and No. 201510419071.X) disclose various types of marker pens and all of them are provided with a pen shaft, an ink cartridge and a pen tip, wherein the pen tip is arranged inside the pen shaft so as to allow the ink in the ink cartridge to flow to the pen tip. When we write in paper using a marker pen of such type the ink will flow downwards through gravity from the ink cartridge by its own weight, if the volume of the ink cartridge is too large, the ink may ooze from the pen tip. In order to avoid the leakage, the volume of the ink cartridge tends to be small. Therefore, how to design a writing instrument with comparatively large ink storage without ink leakage is a technical problem to be solved by the present invention.

SUMMARY OF THE INVENTION

The technical problem to be solved by the present invention is to provide a writing instrument with comparatively large ink storage without ink leakage when users writing, so as to improve user experience.

The present invention provides a writing instrument including a pen cap, a pen tip and a pen barrel, wherein the pen tip is arranged at one end of the pen barrel, an ink cartridge configured to store ink is formed at the other end of the pen barrel, and the pen cap able to be removed is provided on the pen barrel for covering the pen tip; wherein the writing instrument further includes: an ink delivery assembly including a first tube body, a second tube body, a liquid guiding column and liquid absorbent cotton, wherein the second tube body is inserted into the first tube body, the liquid guiding column is inserted into the second tube body, the liquid absorbent cotton is arranged inside the first tube body, an inner end of the pen tip is inserted into the first tube body, and an end of the first tube body which is away from the pen tip is opened with a first vent and an end of the second tube body which is close to the pen tip is opened with a second vent; the first tube body is arranged in the pen barrel; an air flow channel is formed between an inner wall of the pen barrel and the first tube body; the second tube body is in communication with the ink cartridge; a part of the pen barrel corresponding to where the pen tip is arranged is provided with a plurality of ribs, and an air inlet is enclosed by the pen tip and any two adjacent ribs, and the air inlet is in communication with the air flow channel.

Further the part of the pen tip located in the first tube body is wrapped by the liquid absorbent cotton and the liquid absorbent cotton is disposed between the pen tip and the second tube body.

Further the second tube body is wrapped by the absorbent cotton.

Further the first vent is opened at a wall of the first tube body.

Further the second vent is opened at a wall of the second tube body, or the second vent is a tube mouth of the second tube body facing the pen tip.

Further an outer wall of the first tube body is provided with a groove extending along a length direction of the first tube body; the first vent is located in the groove and the air flow channel is formed between the groove and an inner wall of the pen barrel.

Further the air inlet is formed between the pen tip and the pen barrel, and the air inlet is in communication with the air flow channel.

Further the pen barrel includes a first rod body and a second rod body; the first rod body is connected to the second rod body; the pen tip is arranged at an end of the first rod body and the ink cartridge is formed inside the second rod body; an end of the first tube body is inserted into the first rod body and the other end of the first tube body is inserted into the second rod body.

Further the pen barrel includes a third rod body and a fourth rod body; the third rod body is connected to the fourth rod body, the pen tip is arranged at an end of the third rod body and the ink cartridge is formed in the fourth rod body; the first tube body is arranged in the third body and the second tube body is arranged in the fourth rod body.

Compared with the prior art, the advantages and positive effects of the present invention are: the writing instrument provided by the present invention is provided with vents on the first tube body and the second tube body, wherein the first vent of the first tube body is away from the pen tip and the second vent of the second tube body is close to the pen tip, the first vent allows air from outside to enter into the first tube body and then to enter the ink cartridge through the second vent to supplement air pressure after ink flowing out of the ink cartridge. In usage, ink stored in the ink cartridge is introduced into the first tube body through the liquid guiding column in the second tube body, and ink is absorbed by the liquid absorbent cotton around the pen tip to make it write functionally. As ink continues to flow downwards through the liquid guiding column, the liquid absorbent cotton is immersed by ink and the liquid level of ink in the first tube body is just higher than the second vent, air from the outside could not enter the ink cartridge through the second vent so the ink flow stops. With this arrangement, the liquid level of ink in the first tube body is not allowed to exceed the second vent, so that ink in the first tube body could ensure a smooth writing without ink leakage. The vents respectively at the upper end and bottom end make it possible to use air to adjust the outflow ink volume, so as to increase the ink storage capacity while avoid ink leakage as writing, thereby improving user experience.

BRIEF DESCRIPTION OF THE DRAWINGS

The present invention can be better understood by reference to the following drawings, wherein like references numerals represent like elements. The drawings are merely exemplary and the present invention is not limited to the embodiments shown.

DETAILED DESCRIPTION OF THE EMBODIMENTS

In order to make the objectives, technical solutions and advantages of the embodiments of the present invention clearer, the technical solutions in the embodiments of the present invention will be described clearly and completely in conjunction with the accompanying drawings in the embodiments of the present invention. Obviously, the described embodiments are a part of the embodiments of the present invention, not all the embodiments. Based on the embodiments of the present invention, all other embodiments obtained by those of ordinary skill in the art without creative work shall fall within the protection scope of the present invention.

Figure 1:
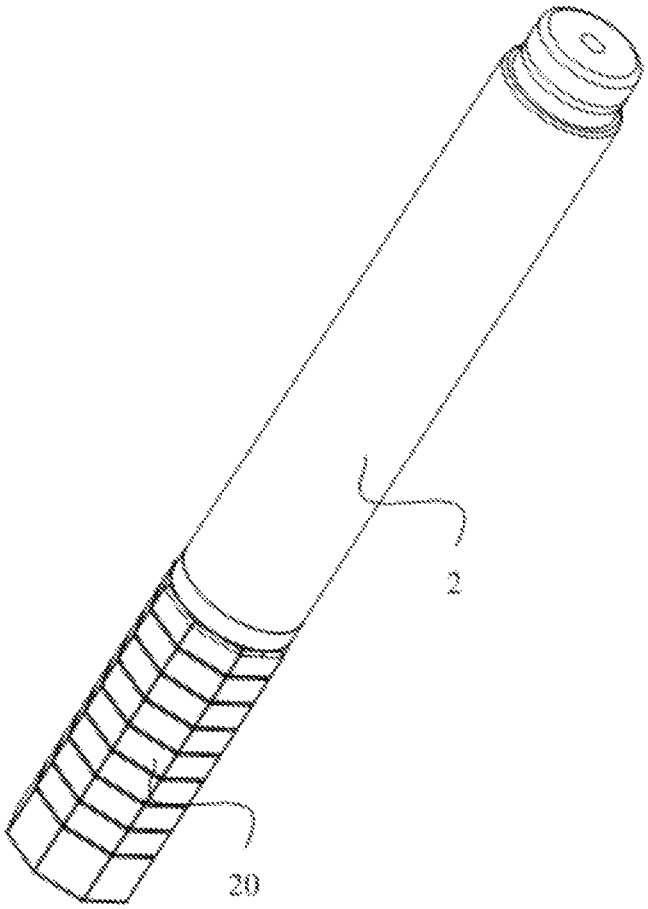
FIG. 1 is a schematic structural diagram of an embodiment of the writing instrument of the present invention.
Figure 2:
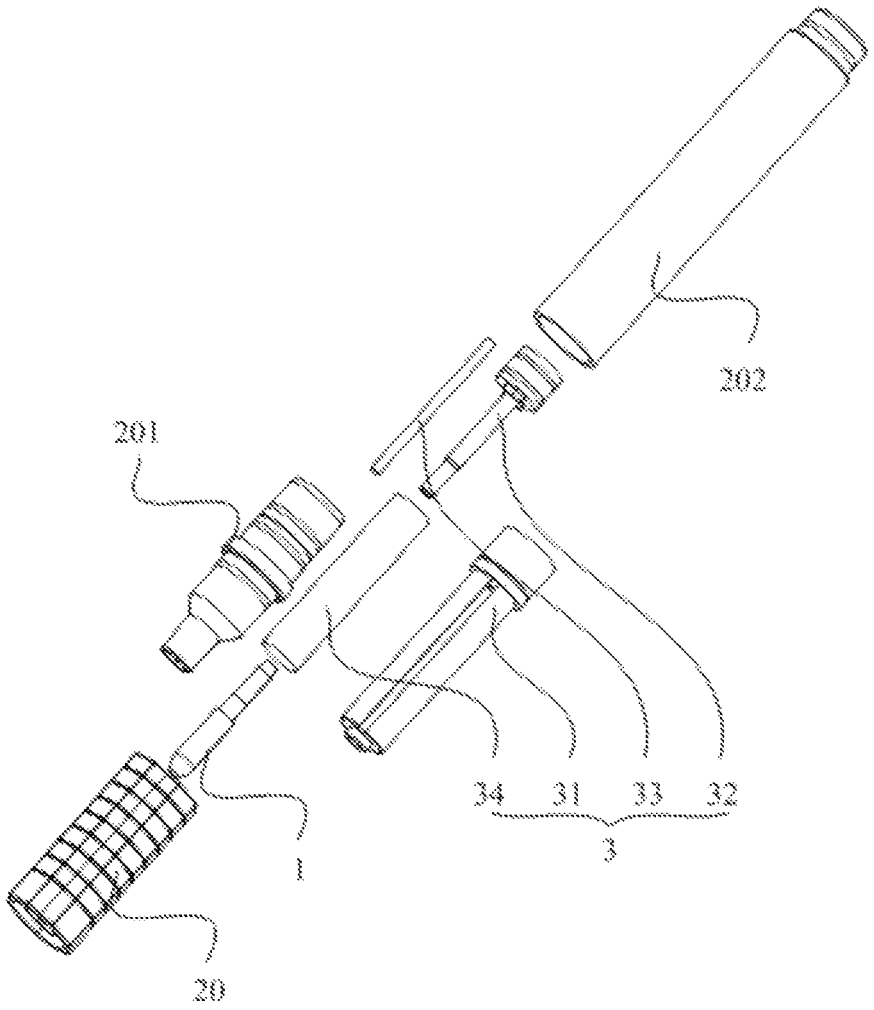
FIG. 2 is an exploded view of an embodiment of the writing instrument of the present invention.
Figure 3:
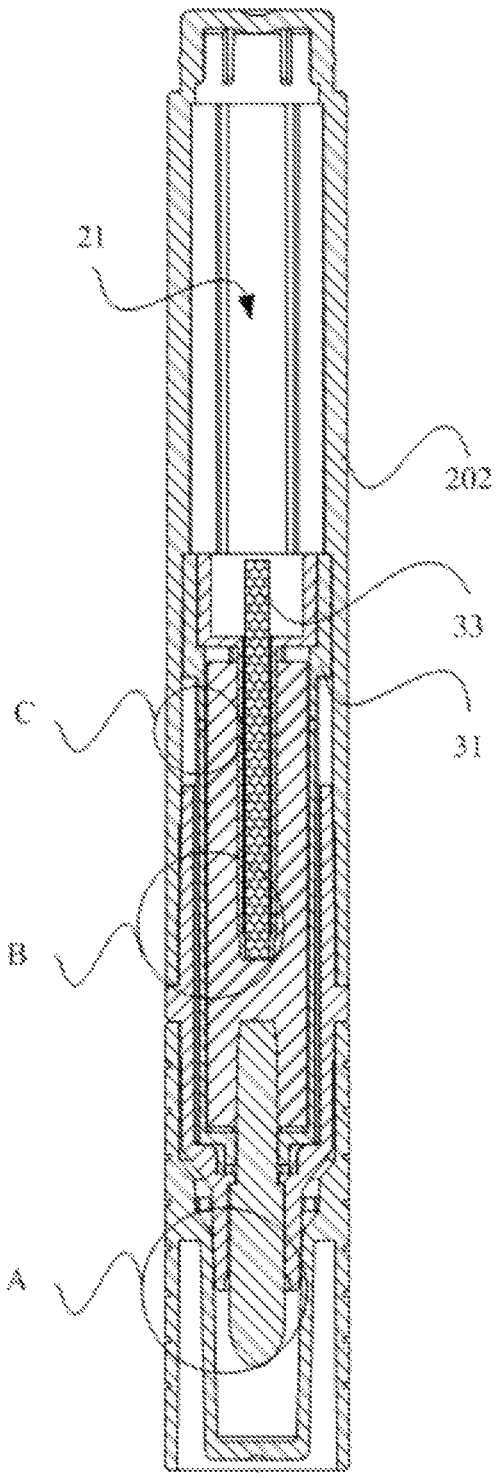
FIG. 3 is a cross-sectional view of an embodiment of the writing instrument of the present invention.
Figure 4:
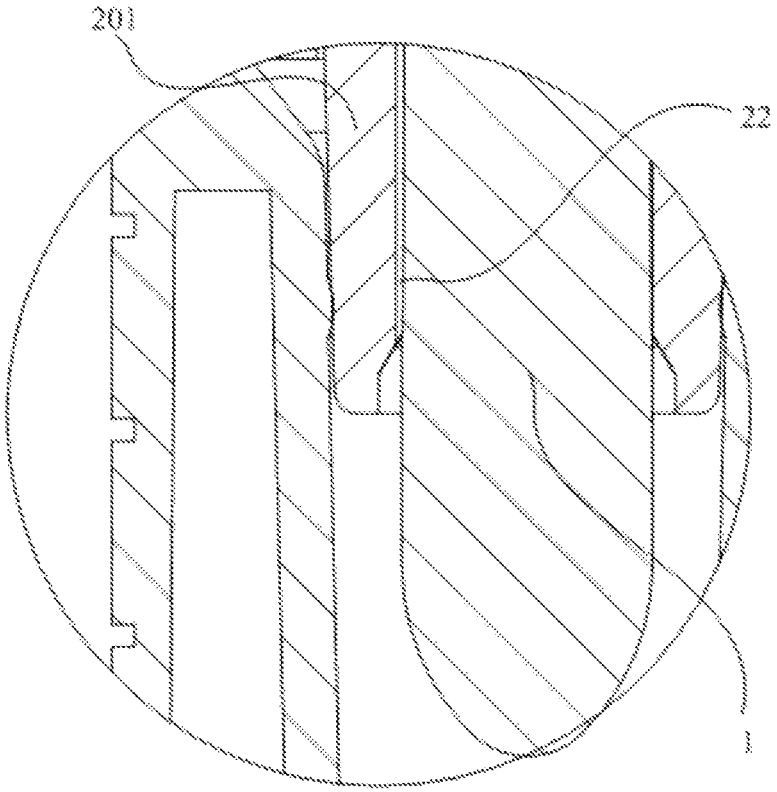
FIG. 4 is a partial enlarged schematic diagram of area A in FIG. 3.
Figure 5:
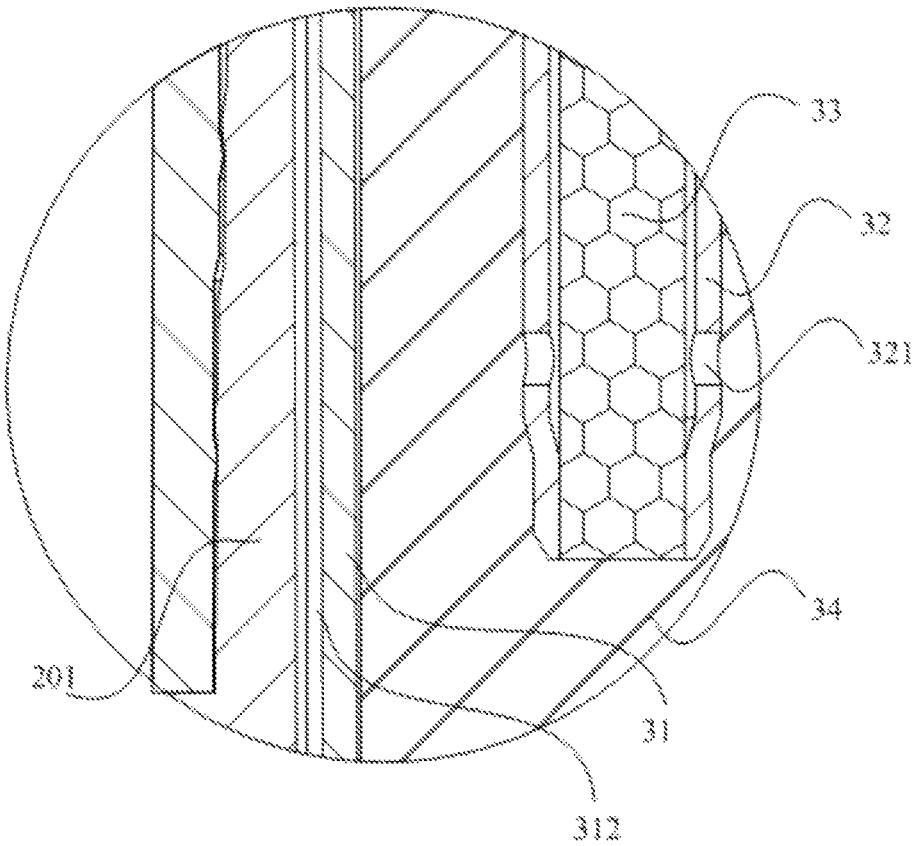
FIG. 5 is a partial enlarged schematic diagram of area B in FIG. 3.
Figure 6:
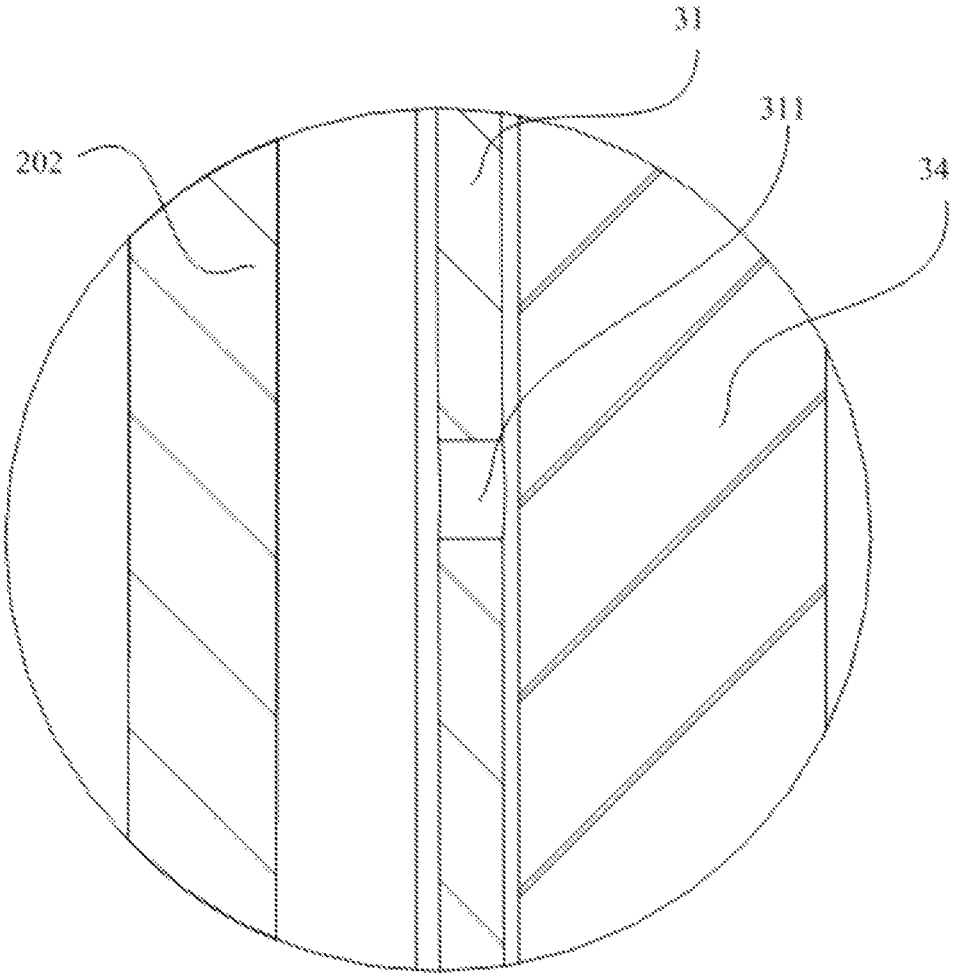
FIG. 6 is a partial enlarged schematic diagram of area C in FIG. 3.
Figure 7:
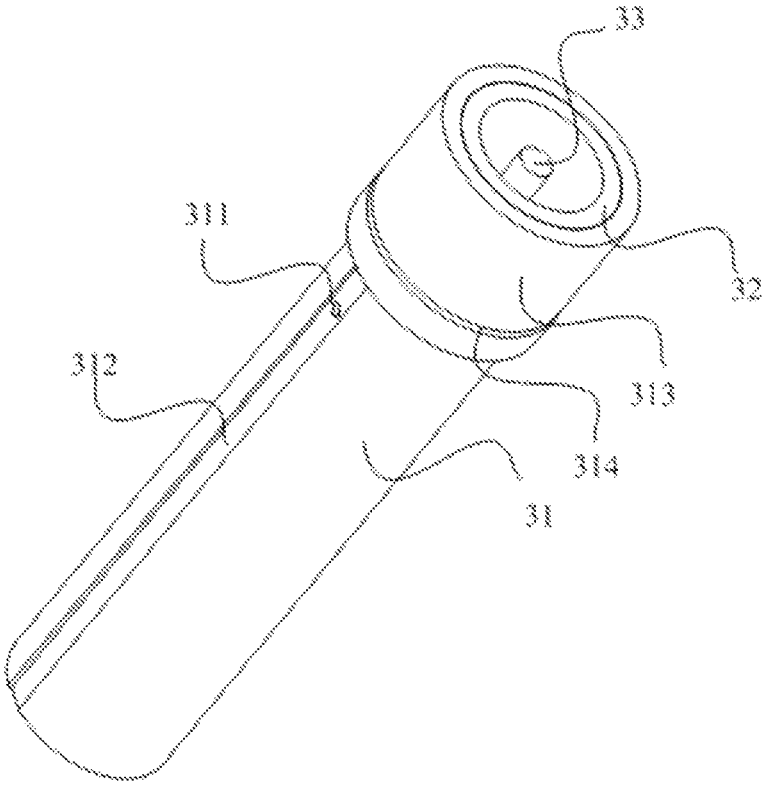
FIG. 7 is an assembly diagram of the ink delivery assembly in the writing instrument according to one aspect of the present invention.
Figure 8:
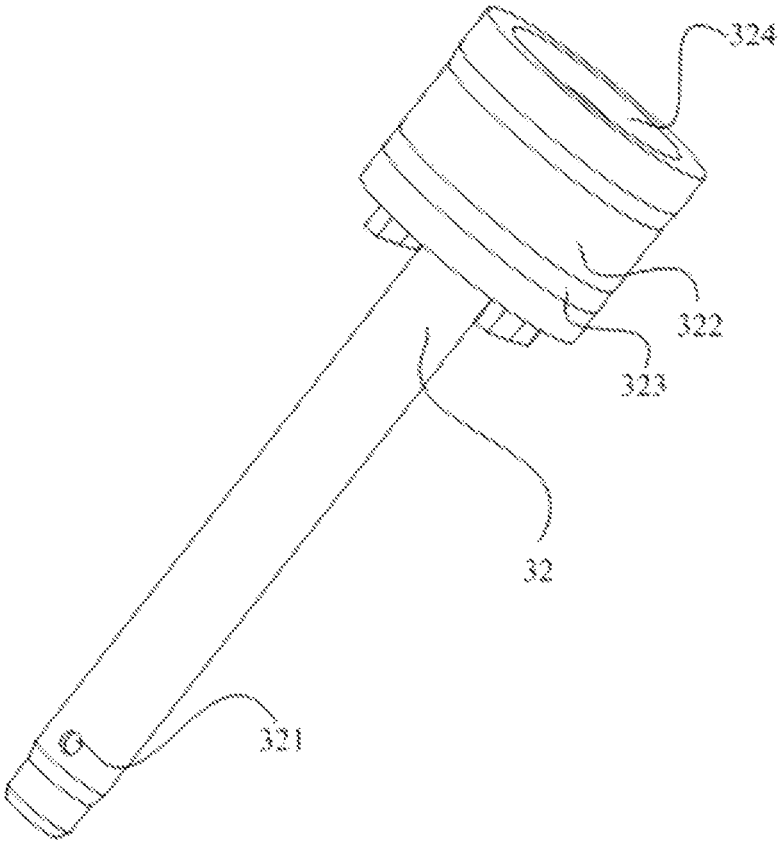
FIG. 8 is a schematic diagram of a second tube body in the writing instrument according to one aspect of the present invention.

Referring now to FIG. 1 to FIG. 8, exemplary writing instrument formed in accordance with the principles of the present invention has a pen tip 1 and a pen barrel 2. The pen tip 1 is arranged at one end of the pen barrel 2, and an ink cartridge 21 configured to store ink is formed at the other end of the pen barrel 2; the writing instrument further includes a pen cap 20 able to be removed, which is provided on the pen barrel for covering the pen tip 1. The writing instrument further includes an ink delivery assembly 3, wherein the ink delivery assembly 3 comprises a first tube body 31, a second tube body 32, a liquid guiding column 33 and liquid absorbent cotton 34. For the ink delivery assembly 3, the second tube body 32 is inserted into the first tube body 31 and the liquid guiding column 33 is inserted into the second tube body 32, the liquid absorbent cotton 34 is arranged inside the first tube body 31, an inner end of the pen tip 1 is inserted into the first tube body 31, and an end of the first tube body 31 which is away from the pen tip 1 is opened with a first vent 311, the second tube body 32 is opened with a second vent 321 at an end close to the pen tip 1; the first tube body 31 is arranged in the pen barrel 2, and an air flow channel (not marked in the figures) is formed between an inner wall of the pen barrel 2 and the first tube body 31 and the second tube body 32 is in communication with the ink cartridge 21.

The writing instrument of the present embodiment is provided with the ink delivery assembly 3 in the pen barrel 2, so that ink stored in the ink cartridge 21 could be delivered to the pen tip 1 when the user is writing. Because when the user writes ink will flow downwards through gravity by its own weight, in order to avoid ink oozing from the pen tip 1, vents (a first vent and a second vent) are respectively opened at the first tube body 31 and the second tube body 32 of the ink delivery assembly 3. The adjustment of the liquid level of ink in the first tube body 31 could be utilized to automatically make the air flow channel of the ink cartridge communicated or blocked, further to maintain the liquid level of ink in the first tube body 31 within a preset range to avoid the ink leakage situation. With regard to the liquid guiding column 33 and the liquid absorbent cotton 34, the liquid guiding column 33 could be a microporous capillary rod made of polyester fiber, polyoxymethylene (POM) and the like and the liquid absorbent cotton 34 could be made of foaming sponge or polyester fiber cotton, and there is no further restriction on the material of the liquid guiding column 33 and the liquid absorbent cotton 34.

When the user writes, the writing instrument generally keeps upright and the ink cartridge 21 is at the top, ink will flow downwards through gravity by its own weight. Ink firstly flows to the second tube body 32 and then flows downwards through the liquid guiding column 33 until out of the second tube body 32, and finally collects at a lower end area of the first tube body 31. The liquid absorbent cotton 34 around the pen tip 1 could be immersed in ink so that a part of the pen tip 1 located in the first tube body 31 could soak in ink which will enable the writing to be smoother.

In the midst of a process when ink flowing out of the ink cartridge 21, air from the outside enters into the first tube body 31 from the first vent 311. Under the effect of negative pressure, air in the first tube body 31 flows into the ink cartridge 21 through the second tube body 32, so that ink stored in the ink cartridge 21 could be pushed out smoothly.

In the midst of a process when ink flowing into the first tube body 31, the liquid level of the ink in the first tube body 31 gradually increases until the second vent 321 at the second tube body 32 being eventually immersed. Under this circumstance, the second vent 321 is being blocked by ink so that air in the first tube body 31 could not able to enter into the ink cartridge 21 through the second tube body 32 further, and ink stored in the ink cartridge 21 could not flow out either. In this way, the liquid level of ink stored in the first tube body 31 could be accurately and reliably controlled. On one hand the writing of the pen tip 1 feels smooth and on the other hand an awkward situation of ink leakage from the pen tip 1 could be prevented, which improves user experience. More importantly with this structure a restriction on the capacity of ink cartridge 21 could be broken: the ink storage capacity of a conventional marker pen is 4 g and the ink storage capacity of the writing instrument of the present invention could be increased to 7 g, so that would be a nearly 200% increase.

When the writing instrument writes, the pen tip 1, the second vent 321 and the first vent 311 are arranged from bottom to top sequentially along a height direction of the writing instrument. The pen tip 1 is immersed by ink in the first tube body 31 in usage so as to make writing smooth, air from the outside could enter into the first tube body 31 through the first vent 311 so as to satisfy a requirement of air pressure balance to enable ink stored in the ink cartridge 21 to flow out, and the liquid level of ink in the first tube body 31 could be controlled due to the opening of the second vent 321 at the bottom of the second tube body 32, so as to allow an increase of ink storage capacity. With these arrangements, it could ensure smooth writing and avoid ink leakage while effectively increasing the volume of the ink cartridge 21, thereby improving user experience.

Further preferably the bottom of the first tube body 31 is filled with the liquid absorbent cotton 34 so that the part of the pen tip 1 located in the first tube body 31 is wrapped by the liquid absorbent cotton 34. The liquid absorbent cotton 34 is disposed between the pen tip 1 and the second tube body 32, and the liquid absorbent cotton 34 is able to absorb ink flowing out from the second tube body 32 so as to improve the ink output efficiency. Further, the second tube body 32 could be completely wrapped by the liquid absorbent cotton 34.

Further with regard to the position of the first vent 311 and the second vent 321, the first vent 311 is preferably opened at a wall of the first tube body 31 to allow air which flows into the pen barrel 12 from the outside to enter the first tube body 31 via the first vent 311 at the first tube body 31; the second vent 321 could be opened at a wall of the second tube body 32, the second vent 321 also could be a tube mouth of the second tube body 32 facing the pen tip 1.

Preferably, in order to ensure that air could enter into the first tube body 31 via the first vent 311 smoothly, an outer wall of the first tube body 31 is provided with a groove 312 extending along a length direction of the first tube body 31 and the first vent 311 is located in the groove 312. The air flow channel is formed between the groove 312 and an inner wall of the pen barrel 2. To be specific, the arrangement of the groove 312 allows more space between the groove 312 and the inner wall of the pen barrel 2 to spare so air could flow smoother, especially being beneficial to the flow of air from the outside into the first tube body 31. Air from the outside could flow into the pen barrel 2 via an air inlet channel (not marked in the figures) formed between the pen tip 1 and pen barrel 2. The air inlet channel is in communication with the air flow channel. Preferably, an inner part of the pen barrel where the pen tip 1 is arranged is provided with a plurality of ribs 22, and the air inlet is enclosed by the pen tip and any two adjacent ribs and the air inlet is in communication with the air flow channel.

Further, in order to facilitate a sealing connection between the ink delivery assembly 3 and the ink cartridge 21 formed in the pen barrel 2, a first sealing connector 313 is formed at an upper end of the first tube body 31 and a first sealing ring 314 is arranged on an outer circumference of the first sealing connector 313. The first tube body 31 is arranged inside the pen barrel 2 so that the first sealing ring 314 could be in close contact with the inner wall of the pen barrel 2 to seal the ink cartridge 21 in the pen barrel 2. A mounting groove with a larger size is formed in the first sealing connector 313 to further form a stepped hole in the first tube body 31. A second sealing connector 322 is formed at an upper end of the second tube body 32 and a second sealing ring 322 is arranged in the mounting groove formed in the first sealing connector 313 and a second sealing ring 323 is arranged on an outer circumference of the second sealing connector 322 so as to realize a sealing connection between the second sealing connector 322 and the first sealing connector 313. Additionally, in order to enable the liquid guiding column 33 to divert the ink smoothly, an oil groove 324 is formed inside the second sealing connector 322. The oil groove 324 is in communication with the ink cartridge 21, and an end of the liquid guiding column 33 extends into the oil groove 324. When the writing instrument writes, the oil groove 324 is filled with ink so that the upper end of the liquid guiding column 33 is immersed in the ink, thereby ensuring that the ink could flow smoothly into the first tube body 31 through the liquid guiding column 33.

On the basis of the technical solution mentioned above, optionally the pen barrel 2 includes a first rod body 201 and a second rod body 202 which are connected together. The pen tip 1 is arranged at a first end of the first rod body 201 and the ink cartridge 21 is formed inside the second rod body 202. An end of the first tube body 31 is inserted into the first rod body 201 and the other end of the first tube body 31 is inserted into the second rod body 202. To be specific, the pen barrel 2 is assembled by connecting the first rod body 201 and the second rod body 202, and the first rod body 201 and the second rod body 202 could be connected by means of conventional methods such as plug connection or screw connection. Wherein the first end of the first rod body 201 is configured to install the pen tip 1 and a second end of the first rod body 201 is configured to install the first tube body 31. After the second rod body 202 is assembled with the first rod body 201, the second end of the first tube body 31 is sealed and inserted into the second rod body 202. For an assembly process, the second rod body 202 is inverted placed to be filled with a certain amount of ink; the pen tip 1 is inserted into the assembled ink delivery assembly 3; and then the first rod body 201 is connected to the second rod body 202 from the top, and the first tube body 31 is inserted into the second rod body 202. For the ink delivery assembly 3, a connection surface between the second end of the first tube body 31 and an upper end of the second tube body 32 forms a sealing connection surface so as to achieve a structure which is used to block the ink cartridge 21 in the second rod body 202 by the first tube body 31. Similarly, a connection surface between the first tube body 31 and the second rod body 202 is a sealing connection surface, and the function of the sealing connection surface alternatively could be realized by adding sealing rings at connecting parts.

In another embodiment, the pen barrel 2 includes a third rod body and a fourth rod body, the third rod body is connected to the fourth rod body, the pen tip 1 is arranged at an end of the third rod body, and the ink cartridge 21 is formed in the fourth rod body. The first tube body 31 is arranged in the third rod body, and the second tube body 32 is arranged in the fourth rod body. Specifically, with regard to the means of the usage of the third rod body and the fourth rod body as described above, the difference from the above-mentioned means of the usage of the first rod body 201 and the second rod body 202 is that the first tube body 31 is completely installed in the third rod body and the second tube body 32 is connected with the fourth rod body to completely block the ink cartridge 21 in the fourth rod body.

Compared with the prior art, the advantages and positive effects of the present invention are: the writing instrument provided by the present invention is provided with vents on the first tube body and the second tube body, wherein the first vent of the first tube body is away from the pen tip and the second vent of the second tube body is close to the pen tip, the first vent allows air from outside to enter into the first tube body and then to enter the ink cartridge through the second vent to supplement air pressure after ink flowing out of the ink cartridge. In usage, ink stored in the ink cartridge is introduced into the first tube body through the liquid guiding column in the second tube body, and ink is absorbed by the liquid absorbent cotton around the pen tip to make it write functionally. As ink continues to flow downwards through the liquid guiding column, the liquid absorbent cotton is immersed by ink and the liquid level of ink in the first tube body is just higher than the second vent, air from the outside could not enter the ink cartridge through the second vent so the ink flow stops. With this arrangement, the liquid level of ink in the first tube body is not allowed to exceed the second vent, so that ink in the first tube body could ensure a smooth writing without ink leakage. The vents respectively at the upper end and bottom end make it possible to use air to adjust the outflow ink volume, so as to increase the ink storage capacity while avoid ink leakage as writing, thereby improving user experience.

Finally, it should be noted that the above embodiments are only used to illustrate the technical solutions of the present invention, not to limit it; although the present invention has been described in detail with reference to the foregoing embodiments, those of ordinary skill in the art should understand that: the technical solutions recorded in the foregoing embodiments are modified, or some of the technical features are equivalently replaced; these modifications or replacements do not cause the essence of the corresponding technical solutions to deviate from the spirit and scope of the technical solutions of the embodiments of the present invention.

The invention claimed is:

1. A writing instrument comprising a pen cap, a pen tip and a pen barrel, wherein the pen tip is arranged at one end of the pen barrel, an ink cartridge configured to store ink is formed at the other end of the pen barrel, and the pen cap able to be removed is provided on the pen barrel for covering the pen tip; wherein the writing instrument further comprises:

an ink delivery assembly including a first tube body, a second tube body, a liquid guiding column and liquid absorbent cotton, wherein the second tube body is inserted into the first tube body, the liquid guiding column is inserted into the second tube body, the liquid absorbent cotton is arranged inside the first tube body, an inner end of the pen tip is inserted into the first tube body, and an end of the first tube body which is away from the pen tip is opened with a first vent and an end of the second tube body which is close to the pen tip is opened with a second vent; the first tube body is arranged in the pen barrel;

an air flow channel is formed between an inner wall of the pen barrel and the first tube body; the second tube body is in communication with the ink cartridge; a part of the pen barrel corresponding to where the pen tip is arranged is provided with a plurality of ribs, and an air inlet is enclosed by the pen tip and any two adjacent ribs, and the air inlet is in communication with the air flow channel;

wherein the second vent is opened at a wall of the second tube body and spaced apart from a tube mouth of the second tube body facing the pen tip; and wherein an outer wall of the first tube body is provided with a groove extending along a length direction of the first tube body; the first vent is located in the groove and the air flow channel is formed between the groove and an inner wall of the pen barrel.

2. The writing instrument of claim 1, wherein the part of the pen tip located in the first tube body is wrapped by the liquid absorbent cotton and the liquid absorbent cotton is disposed between the pen tip and the second tube body.

3. The writing instrument of claim 2, wherein the second tube body is wrapped by the absorbent cotton.

4. The writing instrument of claim 1, wherein the first vent is opened at a wall of the first tube body.

5. The writing instrument of claim 1, wherein the pen barrel includes a first rod body and a second rod body; the first rod body is connected to the second rod body; the pen tip is arranged at an end of the first rod body and the ink cartridge is formed inside the second rod body; an end of the first tube body is inserted into the first rod body and the other end of the first tube body is inserted into the second rod body.

6. The writing instrument of claim 1, wherein the pen barrel includes a third rod body and a fourth rod body; the third rod body is connected to the fourth rod body, the pen tip is arranged at an end of the third rod body and the ink cartridge is formed in the fourth rod body; the first tube body is arranged in the third body and the second tube body is arranged in the fourth rod body.

7. A writing instrument comprising a pen cap, a pen tip and a pen barrel, wherein the pen tip is arranged at one end of the pen barrel, an ink cartridge configured to store ink is formed at the other end of the pen barrel, and the pen cap able to be removed is provided on the pen barrel for covering the pen tip; wherein the writing instrument further comprises:

an ink delivery assembly including a first tube body, a second tube body, a liquid guiding column and liquid absorbent cotton, wherein the second tube body is inserted into the first tube body, the liquid guiding column is inserted into the second tube body, the liquid absorbent cotton is arranged inside the first tube body, an inner end of the pen tip is inserted into the first tube body, and an end of the first tube body which is away from the pen tip is opened with a first vent and an end of the second tube body which is close to the pen tip is opened with a second vent; the first tube body is arranged in the pen barrel;

an air flow channel is formed between an inner wall of the pen barrel and the first tube body; the second tube body is in communication with the ink cartridge; a part of the pen barrel corresponding to where the pen tip is arranged is provided with a plurality of ribs, and an air inlet is enclosed by the pen tip and any two adjacent ribs, and the air inlet is in communication with the air flow channel;

wherein the part of the pen tip located in the first tube body is wrapped by the liquid absorbent cotton and the liquid absorbent cotton is disposed between the pen tip and the second tube body;

wherein the second tube body is wrapped by the absorbent cotton;

wherein the first vent is opened at a wall of the first tube body;

wherein the second vent is opened at a wall of the second tube body and spaced apart from a tube mouth of the second tube body facing the pen tip;

wherein an outer wall of the first tube body is provided with a groove extending along a length direction of the first tube body; the first vent is located in the groove and the air flow channel is formed between the groove and an inner wall of the pen barrel;

wherein the pen barrel includes a first rod body and a second rod body; the first rod body is connected to the second rod body; the pen tip is arranged at an end of the first rod body and the ink cartridge is formed inside the second rod body; an end of the first tube body is inserted into the first rod body and the other end of the first tube body is inserted into the second rod body; and wherein the pen barrel includes a third rod body and a fourth rod body; the third rod body is connected to the fourth rod body, the pen tip is arranged at an end of the third rod body and the ink cartridge is formed in the fourth rod body; the first tube body is arranged in the third body and the second tube body is arranged in the fourth rod body.

* * * * *